US010649364B1

(12) United States Patent
Hamachi et al.

(10) Patent No.: US 10,649,364 B1
(45) Date of Patent: May 12, 2020

(54) IMAGE FORMING APPARATUS

(71) Applicant: FUJI XEROX CO., LTD., Tokyo (JP)

(72) Inventors: Tomoyuki Hamachi, Kanagawa (JP); Ryo Fukuno, Kanagawa (JP); Daisuke Uchimitsu, Kanagawa (JP); Toshiaki Suzuki, Kanagawa (JP); Makoto Kanno, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/535,192

(22) Filed: Aug. 8, 2019

(30) Foreign Application Priority Data

Mar. 27, 2019 (JP) ..... 2019-059549

(51) Int. Cl.
*G03G 15/08* (2006.01)

(52) U.S. Cl.
CPC ..... *G03G 15/0808* (2013.01); *G03G 15/0868* (2013.01); *G03G 2215/00679* (2013.01)

(58) Field of Classification Search
CPC ..... G03G 15/0865; G03G 15/0808; G03G 15/0887; G03G 15/0889; G03G 15/0868
See application file for complete search history.

(56) References Cited

U.S. PATENT DOCUMENTS

2014/0140740 A1* 5/2014 Yamane ..... G03G 15/0806 399/274
2014/0376973 A1* 12/2014 Watanabe ..... G03G 15/0907 399/270
2015/0331360 A1* 11/2015 Akedo ..... G03G 15/0893 399/254

FOREIGN PATENT DOCUMENTS

JP 04-037774 A 2/1992
JP 2012-163628 A 8/2012

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An image forming apparatus includes a developing device. The developing device transports a two-component developer by a transporting unit so that the two-component developer passes through a developing roller. The two-component developer is stored in a storage chamber provided with a transporting path. The transporting unit rotates in the transporting path. The developing device causes a portion of the two-component developer to overflow from a discharge port provided at the transporting path, and to discharge the two-component developer. The image forming apparatus has a period in which a first operation is executed, the first operation of reversely rotating the transporting unit at a high speed so that a rotational direction of the transporting unit is an opposite direction to that at a time of development and a rotational speed of the transporting unit is higher than that at the time of development.

13 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2019-059549 filed Mar. 27, 2019.

BACKGROUND

(i) Technical Field

The present disclosure relates to an image forming apparatus.

(ii) Related Art

In the related art, as a technique for improving the discharge of a developer in a developing device that discharges a portion of the developer stored in a storage chamber and the like, for example, those described in JP-A 4-037774 and JP-A 2012-163628 below are known.

JP-A 4-037774 discloses an image forming apparatus provided with a developer discharge port at a tip of a developer replenish chamber in a developing device and configured to be capable of reversing an agitating screw that circulates a developer in a developer adhesion chamber and a developer agitation chamber when discharging the developer.

JP-A 2012-163628 discloses an image forming apparatus that includes a developing device provided with a developer transporting unit that transports and circulates a two-component developer stored in a developing container and a discharge port that is provided at the developing container to discharge the two-component developer. When the consumption amount of the toner exceeds a predetermined threshold value, or the degradation degree of the two-component developer in the developing container exceeds a predetermined threshold value, the speed of the developer transporting unit is increased as compared to when it does not exceed the threshold value.

SUMMARY

Aspects of non-limiting embodiments of the present disclosure relate to an image forming apparatus capable of eliminating defective discharge at a discharge port that occurs in a developing device that allows a portion of a two-component developer stored in a storage chamber to overflow and discharge from the discharge port.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a developing device configured to transport a two-component developer by a transporting unit so that the two-component developer passes through a developing roller, the two-component developer including a toner and a carrier, the two-component developer being stored in a storage chamber provided with a transporting path, the transporting unit rotating in the transporting path, and cause a portion of the two-component developer which is being transported by the transporting unit to overflow from a discharge port provided at the transporting path, and to discharge the two-component developer out of the storage chamber, in which the image forming apparatus has a period in which a first operation is executed, the first operation of reversely rotating the transporting unit at a high speed so that (i) a rotational direction of the transporting unit is an opposite direction to that at a time of development and (ii) a rotational speed of the transporting unit is higher than that at the time of development.

BRIEF DESCRIPTION OF THE DRAWINGS

Exemplary embodiments of the present disclosure will be described in detail based on the following figures, wherein.

DETAILED DESCRIPTION

Hereinafter, embodiments of the present disclosure will be described with reference to the drawings.

Exemplary Embodiment 1

Figure 1:
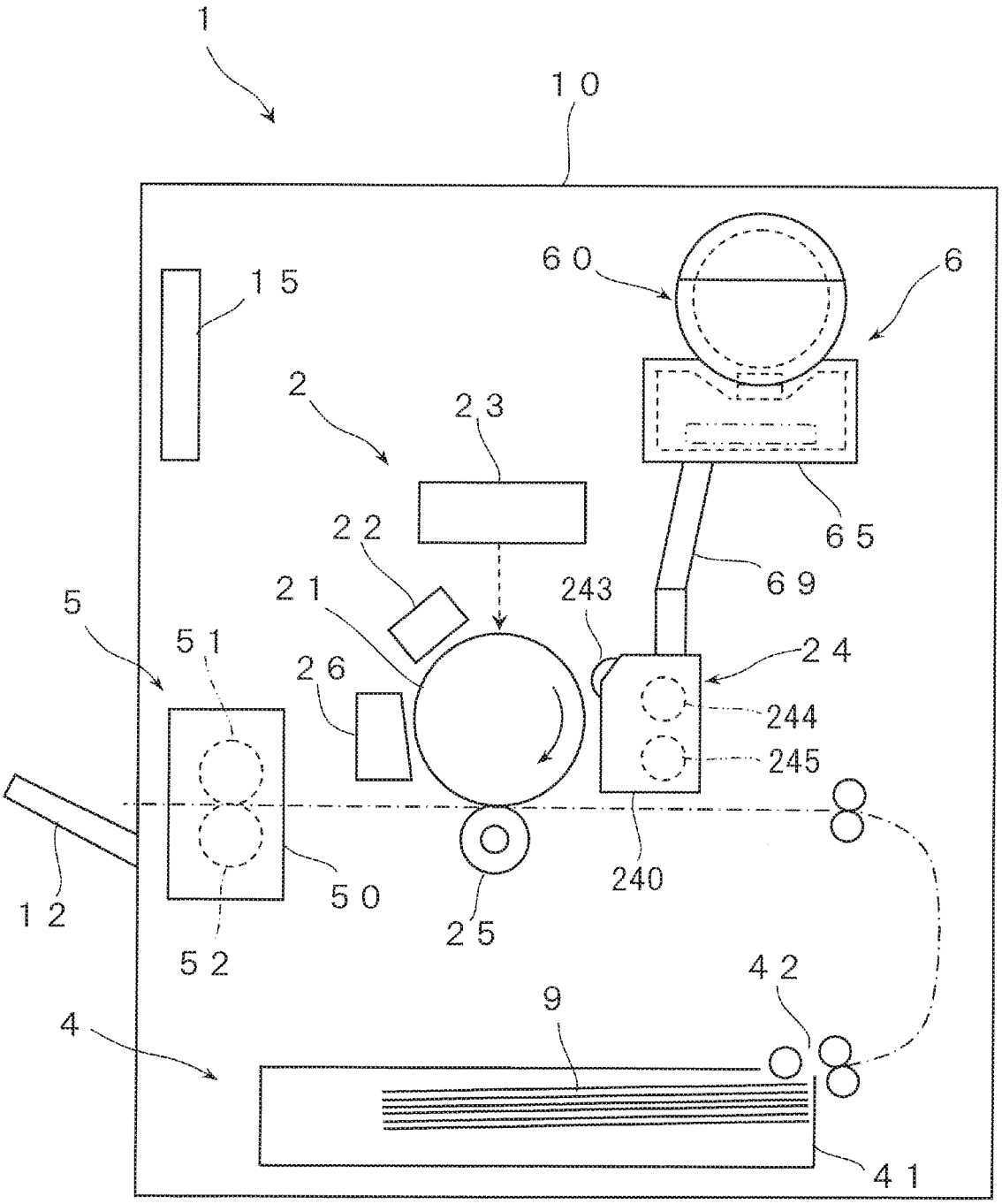
FIG. 1 is a schematic diagram showing a configuration of an image forming apparatus according to Exemplary Embodiment 1.

FIG. 1 schematically shows a configuration of an image forming apparatus 1 according to Exemplary Embodiment 1.

Image Forming Apparatus

The image forming apparatus 1 is an apparatus that forms an image with a toner (serving as a developer) on paper 9 as an example of a recording medium using an image forming method such as an electrophotographic process. The image forming apparatus 1 is configured, for example, as a printer that forms an image corresponding to image information such as characters, figures, tables, and photographs input from an external device such as an information terminal and an image reading device.

In the image forming apparatus 1, as shown in FIG. 1, an image forming unit 2 that forms a toner image by an image-forming method such as an electrophotographic process and transfers the toner image to the paper 9, a paper feeding unit 4 that stores and feeds the paper 9 to be fed to the image forming unit 2, and a fixing unit 5 that fixes the toner image transferred by the image forming unit 2 to the paper 9 are disposed in an internal space of a housing 10. One-dot chain line shown in FIG. 1 is a leading transporting path along which the paper 9 is transported in the internal space of the housing 10. Further, reference numeral 15 in FIG. 1 shows a control unit that controls each operation in the image forming apparatus 1.

The image forming unit 2 has a photoconductive drum 21 which is an example of a photoconductor which rotates in a direction indicated by an arrow. Around the photoconductive drum 21, a charging device 22 for charging an image forming region on a peripheral surface of the photoconductive drum 21 to a required potential, an exposure device 23 for exposing the charged image forming region of the photoconductive drum 21 based on image information to form an electrostatic latent image, a developing device 24 for developing the electrostatic latent image formed on the photoconductive drum 21 by the developer to form a toner image, a transferring device 25 for transferring the toner image formed on the photoconductive drum 21 to the paper 9, a cleaning device 26 for cleaning the image forming region of the photoconductive drum 21, and the like are disposed.

The paper feeding unit 4 is provided with a container 41 (not shown) for storing the paper 9 having a desired size, type, and the like in a stacked state, a feeding device 42 for feeding the paper 9 one by one from the container 41 toward a transfer portion in the image forming unit 2. The paper 9 may be a recording medium which can be transported in the image forming apparatus 1 and can transfer and fix a toner image.

The fixing unit 5 is provided with a heating rotating body 51 having a roller form, a belt-nip from, and the like which is rotated while being heated by a heating unit (not shown), a pressure rotating body 52 having a roller form, a belt-nip form, and the like in contact with the heating rotating body 51 with a required pressure to form a fixing nip inside a housing 50 of the paper 9 provided with an introduction port (not shown) and a discharge port.

In the image forming apparatus 1, when command information of an operation request for forming the image is received, the image forming unit 2 first executes known processes (charging, exposing, developing, and transferring process) in the image-forming method such as an electrophotographic process.

That is, in the image forming unit 2, a toner image corresponding to the image information is formed on the photoconductive drum 21 through charging, exposing, and developing processes. Thereafter, in the transferring process, the toner image on the photoconductive drum 21 is transferred onto one side of the paper 9 supplied from the paper feeding unit 4. The photoconductive drum 21 after the transfer is cleaned by the cleaning device 26.

Next, the paper 9 holding the toner image transferred by the image forming unit 2 is introduced to a fixing nip in the fixing unit 5, and the toner image is fixed to the paper 9 by being subjected to the fixing process (heating and pressing) when passing through the fixing nip. The paper 9 on which fixing by the fixing unit 5 is finished is transported and stored, for example, in a discharge storage unit 12 provided outside the housing 10.

Thus, the image forming operation on one side of the paper 9 by the image forming apparatus 1 is completed.

Developing Device

Next, the configuration and the like of the developing device 24 in the image forming apparatus 1 will be described in detail.

Figure 2:
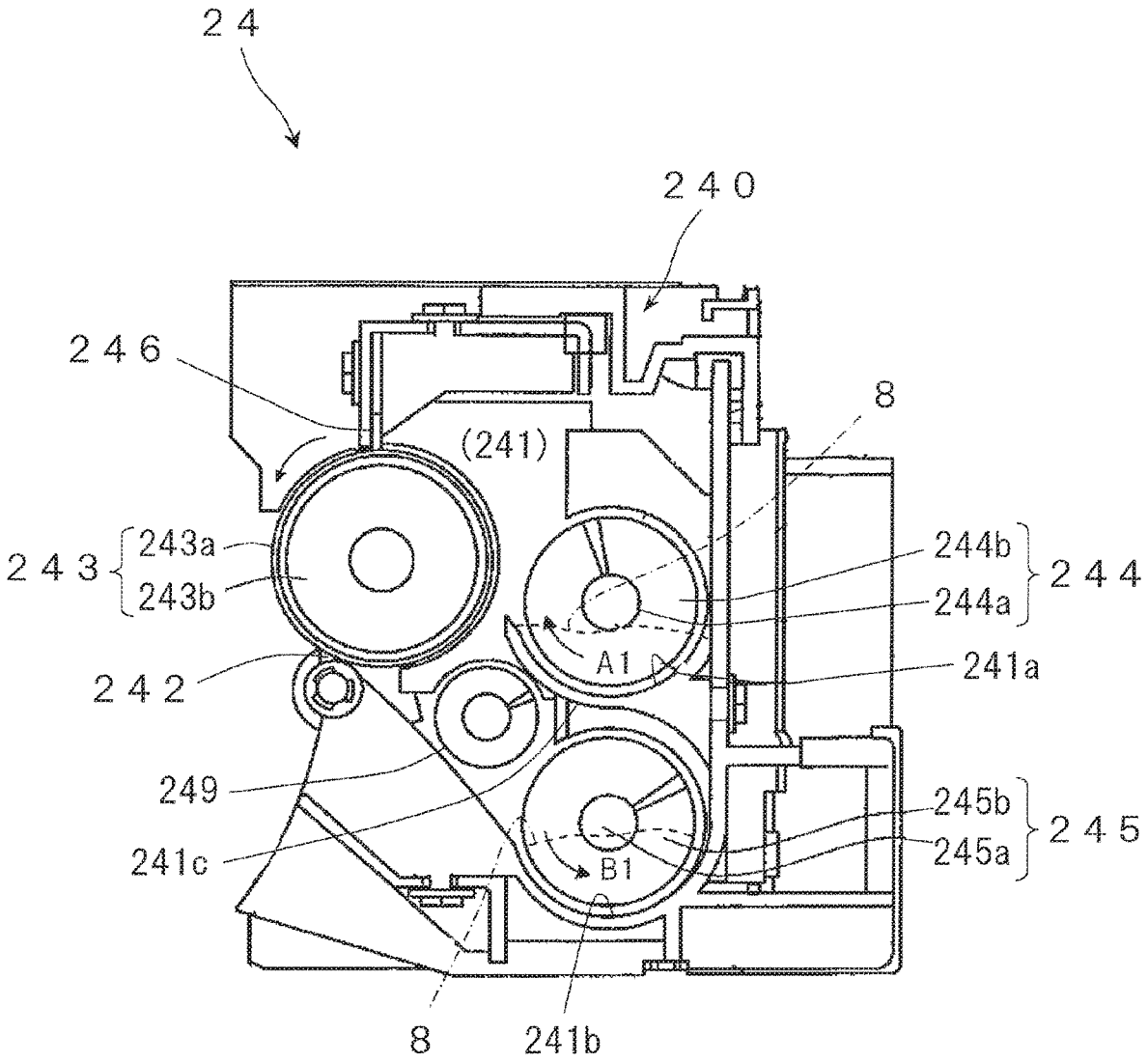
FIG. 2 is a schematic cross-sectional view showing a configuration of a developing device in the image forming apparatus of FIG. 1.
Figure 3:
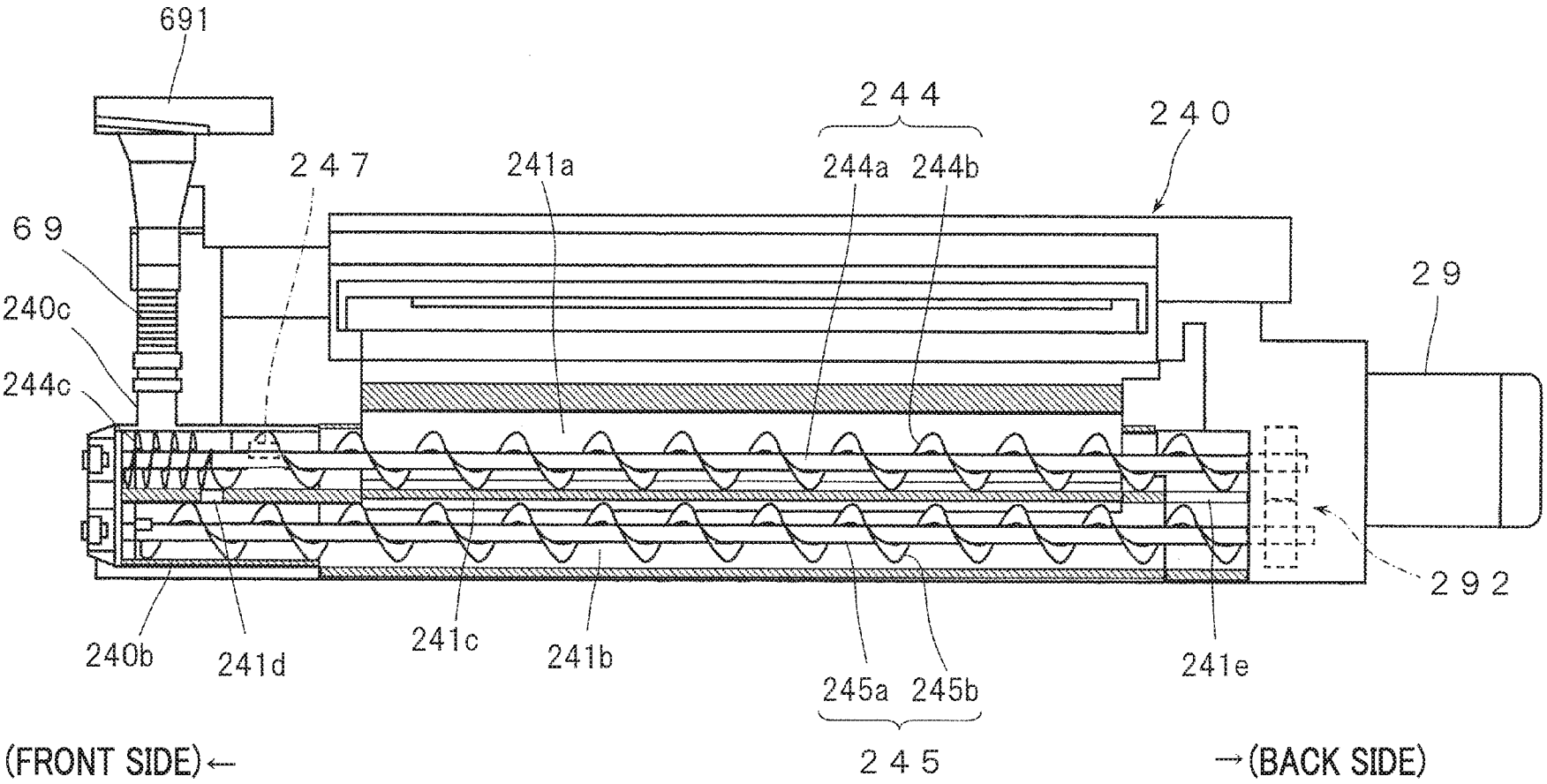
FIG. 3 is a schematic partial sectional view showing a portion of the developing device of FIG. 2.

As shown in FIGS. 1 to 3 and the like, the developing device 24 has a housing 240 having a storage chamber 241 for storing a developer 8 and a development opening 242 for developing.

In addition, the developing device 24 is provided with, inside the housing 240, a developing roller 243 that holds the developer 8 in the storage chamber 241 inside the development opening 242 and rotates and transports it so as to pass a developing area facing the photoconductive drum 21, transporting units 244 and 245 that transport the developer 8 in the storage chamber 241 so as to pass through the developing roller 243 while agitating, a regulating member 246 that regulates the amount of the developer 8 (layer thickness) held by the developing roller 243, and the like.

As the developer 8, for example, a two-component developer including a non-magnetic toner and a magnetic carrier is used. The term "developer 8" hereinafter also refers to a two-component developer. In addition, the left side of a paper surface in FIG. 3 is the front side near to the front of the image forming apparatus 1, and the right side of the paper surface is the back side away from the front surface of the image forming apparatus 1.

The housing 240 is a structure having a horizontally long container shape extending along the axial direction of the photoconductive drum 21. The housing 240 has a structure in which plural members are assembled together to form a desired shape.

The storage chamber 241 is divided into two in the vertical direction along the gravitational direction provided with two transporting paths 241*a* and 241*b* extending substantially along the axial direction of the photoconductive drum 21. The two transporting paths 241*a* and 241*b* are divided up and down by a partition wall 241*c* that partitions the two, and are connected by connection passages 241*d* and 241*e* at positions slightly inside the longitudinal end portion or the end portion. Thereby, in the transporting paths 241*a* and 241*b*, the developer 8 is transferred from one transporting path to the other transporting path through the connection passages 241*d* and 241 *e*.

In addition, between the two transporting paths 241*a* and 241*b*, the upper transporting path 241*a* close to the developing roller 243 serves as a supply transporting path for supplying the developer 8 to the developing roller 243, and the lower transporting path 241*b* away from the developing roller 243 mainly serves as an agitation transporting path for agitating the developer 8.

The development opening 242 is provided as a horizontally long rectangular opening portion extending along the axial direction of the photoconductive drum 21 at substantially the same height position as the upper transporting path 241*a* in the housing 240. In addition, the development opening 242 is respectively connected to the two transporting paths 241*a* and 241*b* via a space along the axial direction of the photoconductive drum 21.

The developing roller 243 is installed inside the housing 240 so that the developing roller 243 rotates while a portion of the peripheral surface is exposed from the development opening 242.

The developing roller 243 includes a cylindrical sleeve 243*a* supported so as to rotate in the developing area facing the outer peripheral surface of the photoconductive drum 21 on which the electrostatic latent image is formed, and a magnet roller 243*b* provided on the side surface portion of the housing 240 so as to be fixed inside the cylindrical space of the sleeve 243*a* and having plural magnetic poles disposed at intervals on the outer peripheral surface. The sleeve 243*a* is formed of a non-magnetic material (for example, stainless steel, aluminum or the like).

In addition, the developing roller 243 rotates in the direction indicated by the arrow when the sleeve 243*a* receives necessary rotational power from a developing drive device 29 (FIG. 3) to the shaft portion at one end portion of the back side. The developing roller 243 is supplied with a developing voltage from a power supply device (not shown) to the sleeve 243*a*, and forms a development electric field with the photoconductive drum 21 at the time of development. The developing drive device 29 is generally provided as a device (independent driving device) separated from the developing device 24, but may be provided integrally with the developing device 24.

The transporting units 244 and 245 are formed in such a forn that transporting blades 244*b* and 245*b* continuous to the peripheral surfaces of the rotational shafts 244*a* and 245*a*, respectively are spirally wound at a required pitch along the axial direction, and is a so-called screw auger. Between the transporting units, the transporting unit 244 is provided on the side surface portion of the housing 240 via a bearing so as to rotate in the upper transporting path 241*a*. The transporting unit 245 is provided on the side surface portion of the housing 240 via a bearing so as to rotate in the lower transporting path 241*b*. Reference numeral 249 in FIG. 2 denotes a feeding transport member which rotates so as to feed the developer 8 separated by the developing roller 243 to the lower transporting path 241*b*.

In addition, the transporting units 244 and 245 are rotated by a portion of the rotational power for rotating the sleeve 243*a* of the developing roller 243 being branched by a driving transmission mechanism 292 such as a gear (not shown) and transmitted to the respective rotational shafts 244*a* and 245*a*. In Exemplary Embodiment 1, as shown in FIG. 2, when viewed from the far front, the transporting unit 244 rotates in a direction indicated by an arrow A1 during transport of the developer 8, and the transporting unit 245 rotates in a direction indicated by an arrow B1 during transport of the developer 8.

The regulating member 246 is a rectangular plate having a length extending along the axial direction of the developing roller 243. The regulating member 246 is formed of a non-magnetic material (for example, stainless steel). Further, one end portion of the regulating member 246 in the longitudinal direction is in a state of facing the outer peripheral surface of the sleeve 243*a* of the developing roller 243 with a required gap (regulating gap), and the regulating member 246 is attached to the upper surface portion of the housing 240 via a support member so as to extend in the axial direction of the sleeve 243*a* and to face each other.

In addition, as shown in FIG. 1 and the like, the developing device 24 is configured such that the developer 8 is replenished from a replenishment unit 6 since the developer 8 in the storage chamber 241 of the housing 240 is consumed and reduced by the development.

As shown in FIG. 1, the replenishment unit 6 includes a developer container 60 for storing the developer 8 to be replenished and detachably mounted to a mounting portion (not shown) of the housing 10, a replenishment drive device 65 for supplying the developer 8 in the developer container 60 to the developing device 24 at a required time and in a required amount, and a transport pipe 69 for transporting the developer 8 fed from the replenishment drive device 65 to the developing device 24. The developer 8 to be replenished is a toner containing a small amount of carrier because the developing device 24 adopts a trickle method described later.

As shown in FIG. 3, in the developing device 24 adopting the replenishment unit 6, the transport pipe 69 of the replenishment unit 6 is connected to an end portion 240*b* on the front side of the upper transporting path 241*a* in the housing 240. The lower end portion of the transport pipe 69 is connected to a replenishment receiving pipe 240*c* provided at the end portion 240*b* on the front side of the housing 240. Reference numeral 691 in FIG. 3 is a connection portion for connecting the lower end portion of the transport pipe 69 on the side of the replenishment drive device 65.

In the developing device 24, the replenishment developer 8 transported through the transport pipe 69 is received in the end portion on the front side of the upper transporting path 241*a*. In the developing device 24, the received developer 8 for replenishment is transported while being mixed with the existing developer 8 up to the connection passage 241*d* on the front side by a replenishment transporting blade 244*c* provided at a narrow pitch at the end portion on the front side of the rotational shaft 244*a* of the transporting unit 244.

Further, the developing device 24 adopts a so-called trickle method in which a portion of the developer 8 stored in the storage chamber 241 of the housing 240 is caused to overflow from the discharge port to be discharged to the out of the storage chamber 241.

In the developing device 24, as shown in FIGS. 3 to 5B and the like, a trickle method discharge port 247 for discharging a portion of the developer 8 is provided at a position before the front end portion of the upper transporting path 241*a*.

Figure 4:
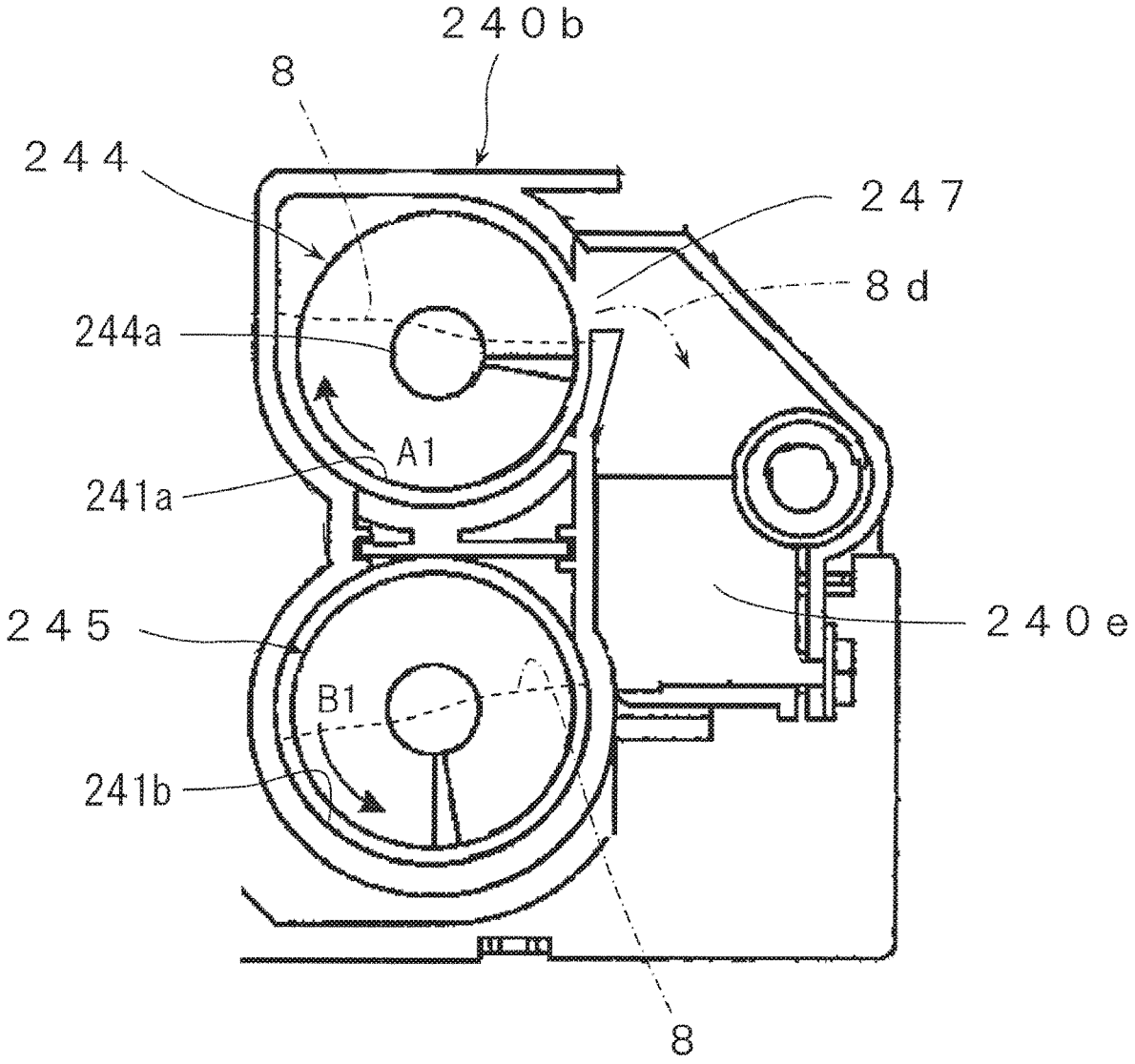
FIG. 4 is a schematic end view showing another portion (portion including discharge port) of the developing device of FIG. 2.
Figure 5A:
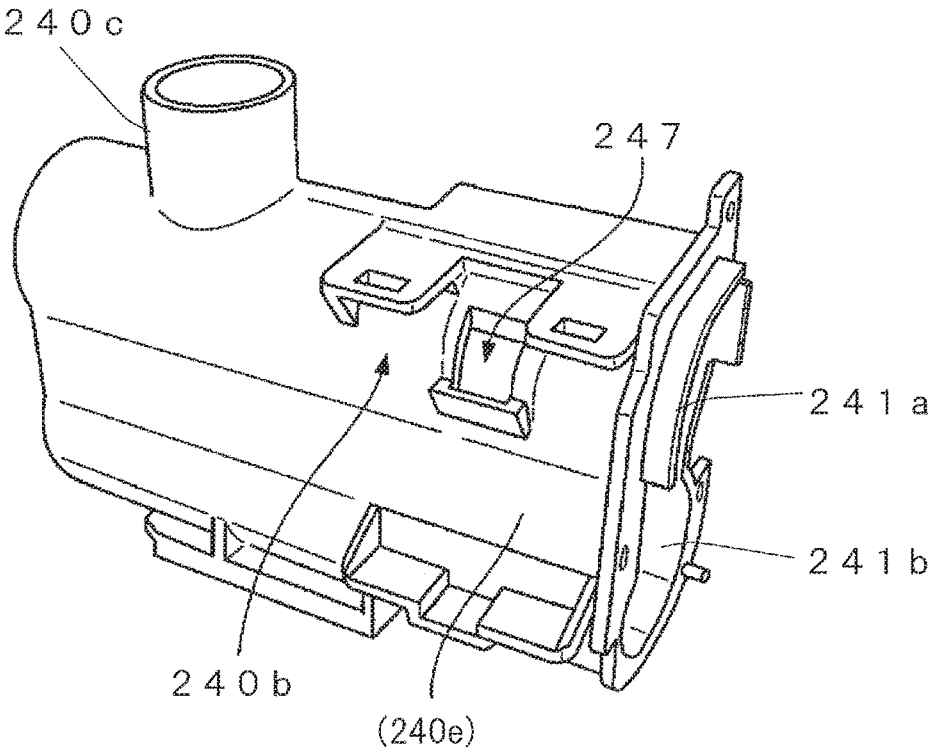
FIG. 5A is a schematic perspective view showing a housing portion provided with a discharge port of the developing device of FIG. 2.
Figure 5B:
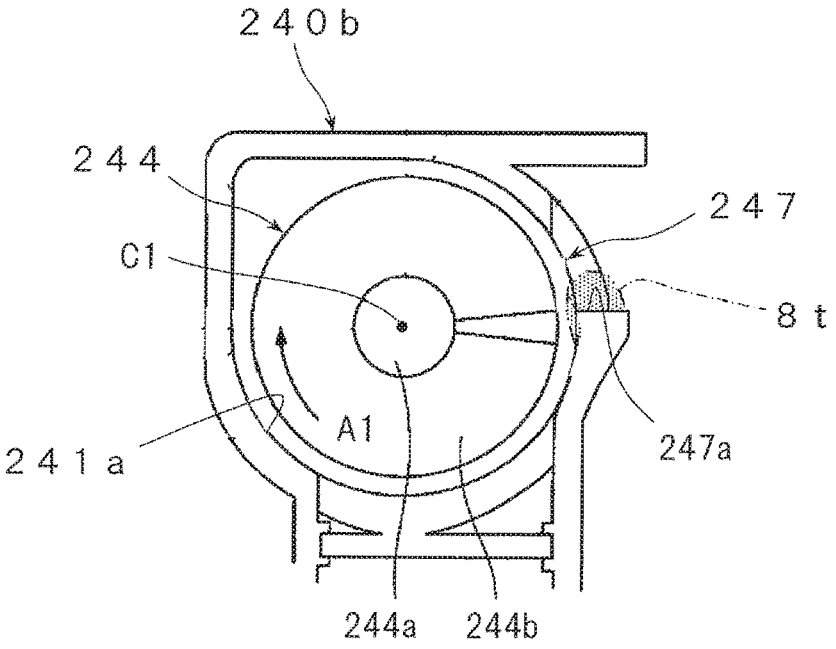
FIG. 5B is a schematic end view showing a configuration of a transporting path provided with the discharge port and a transporting unit.

As shown in FIGS. 4 and 5B, the discharge port 247 is provided at a position higher than a center C1 of the rotational shaft 245*a* of the transporting unit 245 in the upper transporting path 241*a* at the end portion 240*b* on the front side of the housing 240. In addition, as shown in FIG. 3, the discharge port 247 is also provided on the side opposite to the replenishment transporting blade 244*c* and at a position slightly before the connection passage 241*d* on the front side. Furthermore, the gap in the upper portion between the upper transporting path 241*a* at the end portion 240*b* on the front side of the housing 240 and the transporting blade 244*b* of the transporting unit 244 is narrower than the gap in the upper portion between the upper transporting path 241*a* and the transporting blade 244*b* of the transporting unit 244 in a region facing developing roller 243 between the upper transporting path 241*a* of the housing 240. In addition, as shown in FIG. 4, at a portion outside of the discharge port 247 of the housing 240, a container portion 240*e* for storing the developer 8 discharged from the discharge port 247 is provided. The illustration of the container portion 240*e* is omitted in FIGS. 5A and 5B.

The developing device 24 operates as follows when a predetermined drive timing such as image forming operation timing comes.

First, in the developing device 24, as the rotational power is transmitted from the developing drive device 29, the sleeve 243*a* of the developing roller 243 starts to rotate in the direction of the arrow while being partially exposed to the development opening 242 as shown in FIG. 2, and the transporting unit 244 starts to rotate in the direction of the arrow A1 in the upper transporting path 241*a*, the transporting unit 245 starts to rotate in the direction of the arrow B1 in the lower transporting path 241*b*. On the other hand, a developing voltage is supplied to the sleeve 243*a* of the developing roller 243 from a power supply device (not shown).

Figure 6:
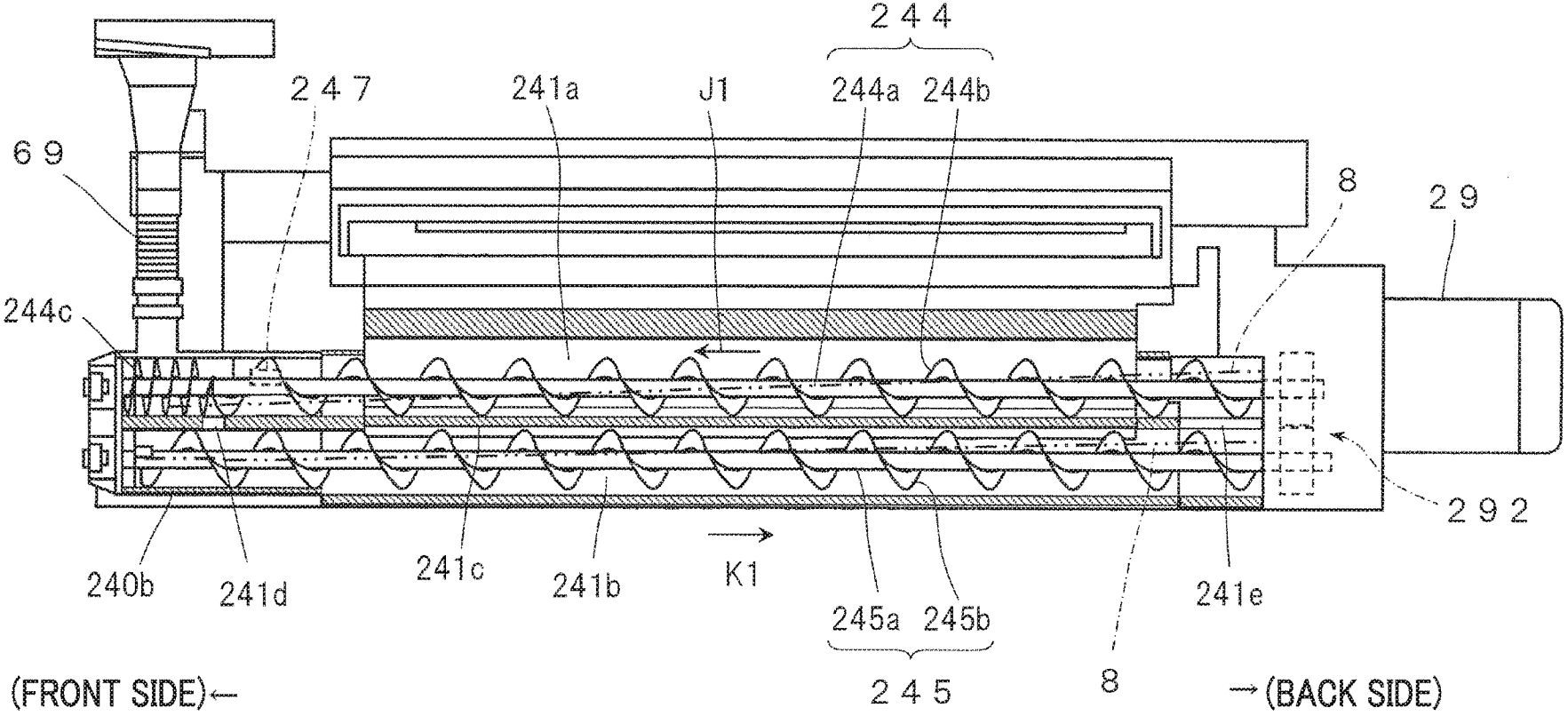
FIG. 6 is a schematic partial sectional view showing a state of a developer in the transporting path at the time of development of the developing device.

Accordingly, as shown in FIG. 6, the developer 8 stored in the upper transporting path 241*a* of the housing 240 in the developing device 24 is transported while being agitated in the direction (direction from the back to the front) indicated by the arrow J1 so as to pass the developing roller 243 by the transporting force of the transporting unit 244 that rotates. The two-dot chain lines in FIG. 6 indicate (the heights of) the surface of the developer 8 in the transporting paths 241*a* and 241*b* when the developer 8 is transported.

At this time, in the upper transporting path 241*a*, a portion of the developer 8 being transported is adsorbed and supplied to the developing roller 243. Although the amount of the developer 8 adsorbed and held by the developing roller 243 is regulated when the regulating member 246 passes, the developer 8 which passed through the regulating member 246 is transported to the developing area facing the photoconductive drum 21 and subjected to the developing process. Furthermore, a portion of the developer 8 after being transported by the developing roller 243 and passing through the developing area is separated from the developing roller 243 and returned to the lower transporting path 241*b*.

The developer 8 which is not adsorbed by the developing roller 243 in the upper transporting path 241*a* and transported to the connection passage 241*d* on the front side is moved to be dropped and delivered to the lower transporting path 241*b* through the connection passage 241*d*.

On the other hand, the developer 8 stored in the lower transporting path 241*b* of the housing 240 is, as shown in FIG. 6, transported while being agitated in the direction (direction from the front to the back) indicated by the arrow K1 by the transporting force of the rotating transporting unit 245 including the developer 8 delivered from the upper transporting path 241*a* through the connection passage 241*d*.

In addition, the developer 8 transported to the connection passage 241*e* on the back side in the lower transporting path 241*b* is being fed to the upper transporting path 241*a* through the connection passage 241*e* under the transporting force of the transporting unit 245. The developer 8 delivered to the upper transporting path 241*a* is similarly transported by the above-described transporting unit 244 in the direction of the arrow J1 as described above.

In this way, the developer 8 is transported so as to circulate and move in a counterclockwise direction between the upper transporting path 241*a* and the lower transporting path 241*b* in FIG. 6 except for a portion such as being adsorbed by the developing roller 243.

In addition, in the developing device 24, when the developer 8 (actually toner) in the storage chamber 241 of the housing 240 is consumed and reduced by the development, the developer 8 is replenished from the replenishment unit 6 based on the information for detecting the decrease in the toner.

That is, at this time, by driving the replenishment drive device 65 in the replenishment unit 6, the replenishment developer 8 stored in the developer container 60 is fed to the end portion on the front side of the upper transporting path 241*a* of the housing 240 through the transport pipe 69 by a required amount. In addition, the replenished developer 8 is transported to the back side in the direction opposite to the arrow J1 by the replenishment transporting blade 244*c* while being mixed with the developer 8 in the upper transporting path 241*a*. However, the replenished developer 8 falls naturally when passing through the connection passage 241*d* on the front side existing on the end portion side of the back of the replenishment transporting blade 244*c*, and is fed to the lower transporting path 241*b*.

Furthermore, since the developing device 24 adopts the trickle method, for example, when the storage surface (developer surface) of the developer 8 transported in the direction of the arrow J1 by the transporting unit 244 in the upper transporting path 241*a*, as shown in FIG. 4, a portion (8*d*) of the developer 8 moves so as to overflow the discharge port 247 and is discharged to the outside of the storage chamber 241.

The developer 8*d* discharged at this time is mainly a carrier but also contains toner. In addition, in the developing device 24, the trickle method operation is performed to keep the storage amount of the developer 8 stored in the storage chamber 241 (particularly the upper transporting path 241*a*) within a substantially constant range.

Configuration of Developing Device

In the developing device 24 adopting the trickle method, for example, if a latent image having a relatively low image density is continuously developed, the following problems occur.

That is, in the storage chamber 241 of the developing device 24 in which development is performed, the consumption amount of the toner of the stored developer 8 is relatively small, so that new developer 8 is not replenished. Thereby, the developer 8 continues to be transported so as to circulate in the storage chamber 241 many times including being returned after being held by the developing roller 243.

As a result, in the developer 8 at this time, its physical properties gradually deteriorate, the fluidity becomes worse, and it becomes difficult to be discharged from the discharge port 247.

According to the researches of the present inventors, when observing the discharge port 247 of the developing device 24 at this time, as shown by a two-dot chain line in FIG. 5B, a portion (mainly toner) 8*t* of the developer 8 is attached so as to be deposited and accumulated around a lower surface part 247*a* of the discharge port 247 facing upward, thereby it is confirmed that a portion of the discharge port 247 is in a closed state (clogged state). In addition, in the developing device 24, it is checked that the developer 8*t* attached to a portion of the discharge port 247 in this manner makes it even more difficult for the developer 8 to be discharged from the discharge port 247 more properly, and the defective discharge of the discharge port 247 tends to be further aggravated.

Figure 7A:
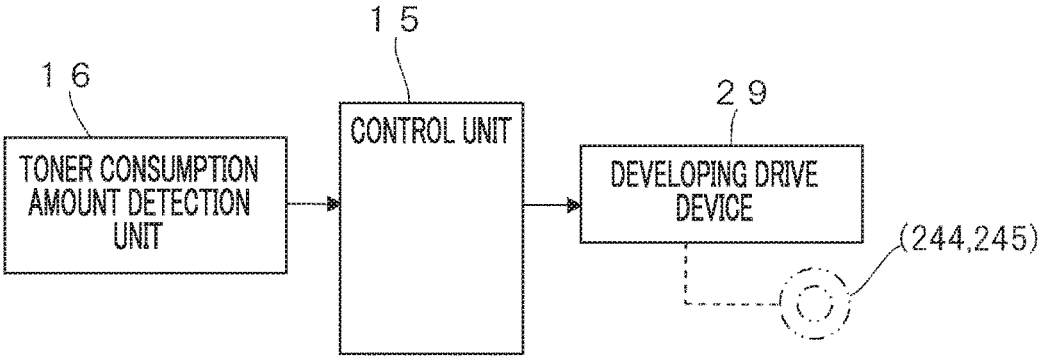
FIG. 7A is a block diagram showing a configuration of a control system related to the developing device in the image forming apparatus.
Figure 7B:
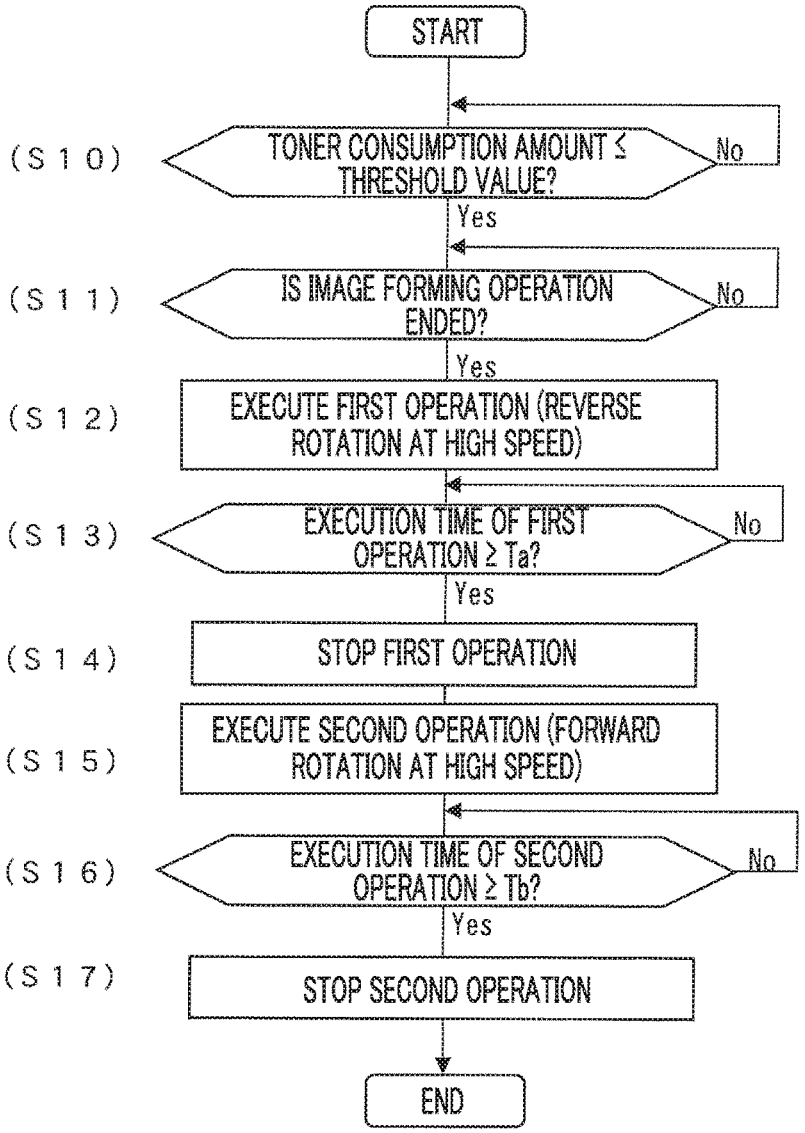
FIG. 7B is a flowchart showing an example of an operation of the developing device.

As shown in FIGS. 7A and 7B, in the image forming apparatus 1 according to Exemplary Embodiment 1, a control unit 15 is configured to execute a first operation and execute a second operation after the first operation. In the first operation, the transporting units 244 and 245 in the developing device 24 are reversely rotated at a high speed so that (i) rotational directions of the transporting units 244 and 245 are directions A2 and B2 opposite to the rotational directions A1 and B1 at a time of development and (ii) rotational speeds of the transporting units 244 and 245 are a speed V2 faster than a rotational speed V1 at the time of the development. In the second operation, the transporting units 244 and 245 are forwardly rotated at a high speed so that (i) the rotational directions of the transporting units 244 and 245 are the same directions as the rotational directions A1 and B1 at the time of development and (ii) the speeds of the transporting units 244 and 245 are a speed V3 faster than the rotational speed V1 at the time of the development.

In Exemplary Embodiment 1, as shown in FIG. 7A, the control unit 15 is connected with a detection unit 16 for detecting the consumption amount of the toner in the developer 8 stored in the storage chamber 241 of the developing device 24, and, as shown in FIG. 7B, when it is determined in the control unit 15 that the consumption amount of the toner detected by the detection unit 16 falls below a threshold value (value serving as a boundary), the control unit 15 controls the operation of the developing drive device 29 to execute the first operation.

The control unit 15 is implemented by, for example, a microcomputer, and performs a required control operation based on a control program or data stored in the memory.

The detection unit 16 is not particularly limited as long as it detects the consumption amount of the toner in the developer 8 of the developing device 24. In Exemplary Embodiment 1, the detection unit 16 is implemented by an image processing unit (not shown) that is configured to obtain information on the image density of the image (latent image) formed by the image forming operation and the number of pages (or the number of sheets of paper 9) in the case of forming continuously. The threshold value for executing the first operation is set, for example, under an image forming condition in which development of a latent image having an image density of 4% or less for one page is continuously executed for 20,000 pages or more. The case of such an image forming condition of a threshold value corresponds to the case where the consumption amount of the toner falls below the threshold value when the first operation is to be performed.

The high speed V2 when reversely rotating the transporting units 244 and 245 in the first operation may be set to a speed (for example, 1.3 times or more) faster than the rotational speed V1 in forward rotation at the time of development.

In the case where the high speed V2 at the reverse rotation is the same as the rotational speed V1 at the forward rotation at the time of development, it is not possible to efficiently increase the height of the surface of the developer 8 in the portion in front of the discharge port 247 in the upper transporting path 241*a* in a short time, and it is difficult to scrape off the developer 8*t* attached to the discharge port 247. The upper limit value of the speed V2 is determined, for example, by the upper limit characteristic of the performance regarding the rotational speed of the developing drive device 29.

Incidentally, when the rotational speeds V1 and V2 (m/s) of the transporting units 244 and 245 are set by the number of revolutions N (rpm), the rotational speeds V1 and V2 may be calculated by the conversion equation of rotational speed $V=(\Pi \cdot D \cdot N)/60$. In the equation, D is the diameter of the transporting blades 244*b* and 245*b* of the transporting units 244 and 245. In addition, when the number of revolutions at this time is not the number of revolutions N of the transporting units 244 and 245 but the number of revolutions Nm of the electric motor in the developing drive device 29, the number of revolutions N of the transporting units 244 and 245 becomes the number of revolutions ($=Nm \times gr$) in which the gear reduction ratio (gr) in the reduction mechanism is reduced from the number of revolutions Nm of the electric motor. In Exemplary Embodiment 1, for example, the value $gr=0.37$ is applied.

In addition, the high speed V3 when the transporting units 244 and 245 are forwardly rotated in the second operation is set to a speed 1.2 or more times as high as the rotational speed V in forward rotation at the time of development.

When the high speed V3 is slower than 1.2 times the rotational speed V1, it is not possible to efficiently increase the internal pressure of the developer 8 in the portion of the upper transporting path 241*a* that is in front of the discharge port 247. The upper limit value of the speed V3 is the same as the upper limit of the speed V2.

In Exemplary Embodiment 1, the execution time T1 of the first operation is set within 5 to 12 seconds (sec). When the execution time T1 is less than 5 seconds, the surface of the developer 8 at the portion in front of the discharge port 247 in the upper transporting path 241*a* may not be heightened to a sufficient height even if the transporting unit 244 is reversely rotated at high speed.

On the other hand, the execution time T2 of the first operation is set within the range of 20 to 60 seconds (sec). When the execution time T2 is less than 20 seconds, it is difficult to level the surface of the developer 8 which is unevenly distributed in the upper transporting path 241*a* in the first operation to a required height even if the transporting unit 244 is forwardly rotated at high speed. The execution time Tb of the first operation is set to be longer than the execution time Ta of the first operation.

The developing drive device 29 is configured to forwardly and reversely rotate the transporting units 244 and 245 in the developing device 24, for example, by switching the rotational direction of the electric motor to forward rotation and reverse rotation. In addition, the developing drive device 29 is configured to rotate the transporting units 244 and 245 at high speeds V2 and V3, respectively, for example, by switching the rotational speed of the electric motor to a speed corresponding to the rotational speed V at the time of development and a speed corresponding to the high speeds V2 and V3.

Furthermore, the developing drive device 29 adopts a one-way transmission method, such as interposing a one-way clutch with the developing roller 243 and the like. Accordingly, the developing drive device 29 is configured to forwardly rotate the developing roller 243 at high speed when executing the second operation. On the other hand, the developing drive device 29 is configured not to rotate the developing roller 243 when executing the first operation.

In the image forming apparatus 1, the first operation and the second operation are executed as described below.

First, as shown in FIG. 7B, the control unit 15 obtains the detection information from the toner consumption amount detection unit 16, and the determination is continued until the toner consumption amount in the developing device 24 becomes equal to or less than the threshold value (step S10: S10).

Next, in the control unit 15, when it is determined in step S10 that the toner consumption amount is equal to or less than the threshold value, prior to executing the first operation, it is determined whether the image forming operation is ended (S11). Since the first operation and the second operation are not executed during the image forming operation, the possibility of causing any trouble to the image forming operation in execution is avoided when the first operation and the second operation are performed.

When it is checked in step S11 that the image forming operation is completed, the first operation is executed in the developing device 24 under the control of the control unit 15 (S12).

Figure 8:
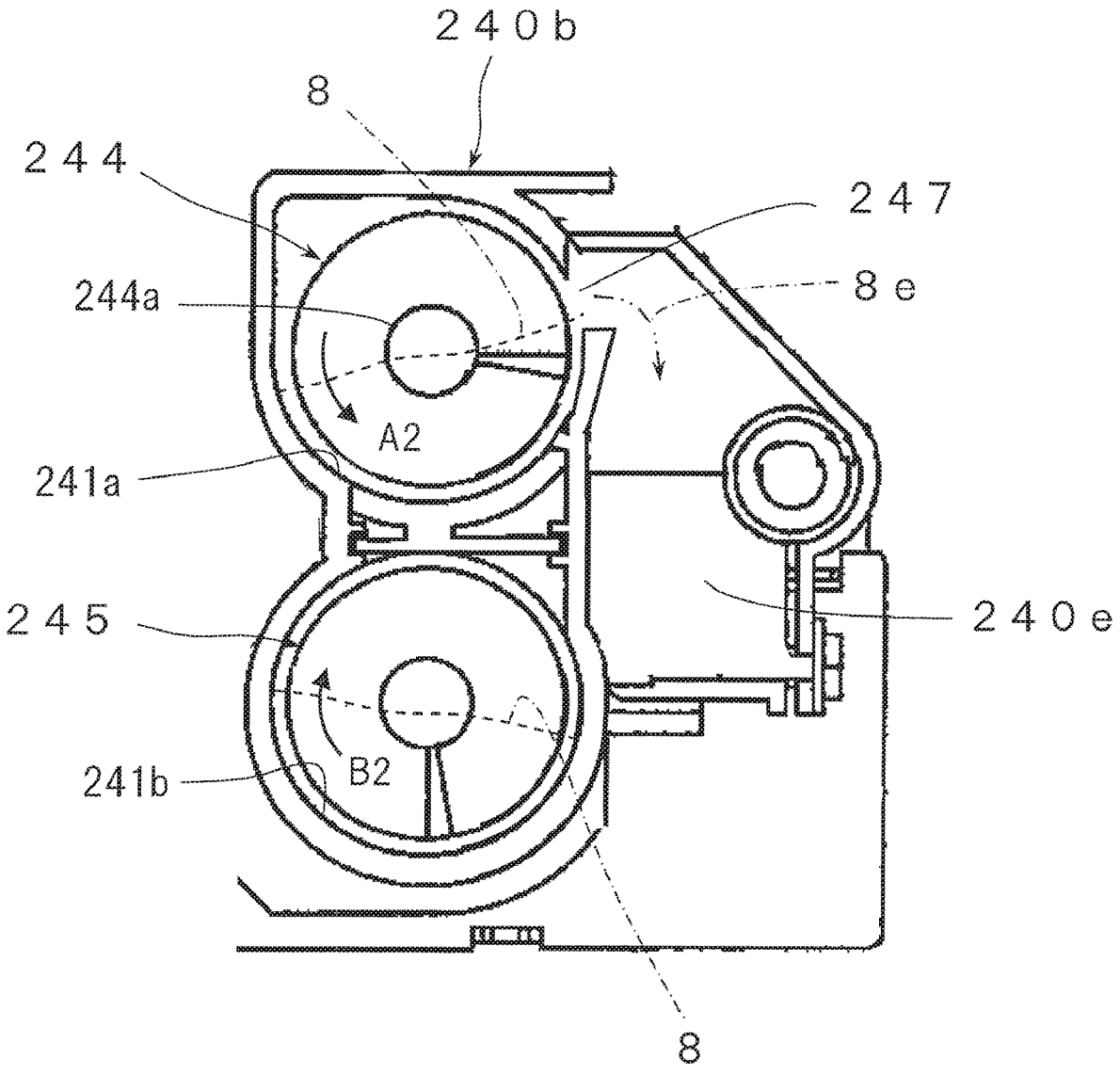
FIG. 8 is a schematic end view showing a state of the transporting unit and the developer when a first operation is executed in the developing device.

That is, in this case, under the control of the control unit 15, the developing drive device 29 operates with the content corresponding to the first operation, thereby the transporting units 244 and 245 in the developing device 24 are reversely rotated at the high speed V2. At this time, the transporting unit 244 rotating in the reverse direction rotates in the direction indicated by the arrow A2 as shown in FIG. 8, and the transporting unit 245 rotating in the reverse direction rotates in the direction indicated by the arrow B2.

Figure 9:
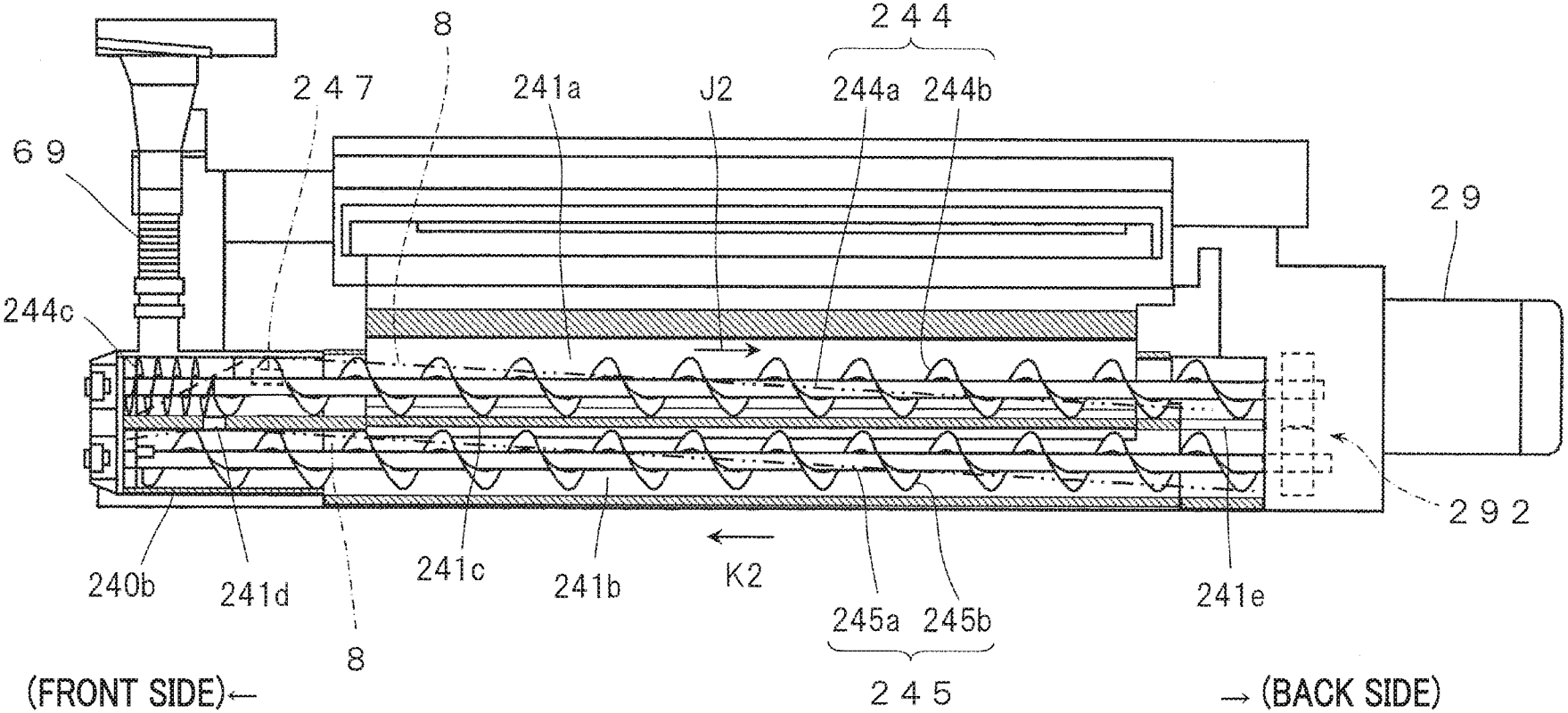
FIG. 9 is a schematic partial sectional view showing a state of the transporting unit and the developer when a second operation is executed in the developing device.

At this time, in the upper transporting path 241*a*, as shown in FIG. 9, the developer 8 is transported at a speed higher than the transporting speed at the time of development in the direction (direction from the front side to the back side) indicated by the arrow J2 opposite to the transport direction J1 at the time of development by the transporting unit 244 reversely rotating at high speed. At this time, the developing roller 243 is not supplied with the developing voltage, and is not rotating. Therefore, a portion of the developer 8 transported in the direction J2 opposite to the direction at the time of development by the transporting unit 244 cannot be adsorbed by the developing roller 243 and transported.

On the other hand, in the lower transporting path 241*b*, as shown in FIG. 9, the developer 8 is transported at a speed higher than the transporting speed at the time of development in the direction (direction from the back side to the front side) indicated by the arrow K2 opposite to the transport direction K1 at the time of development by the transporting unit 245 reversely rotating at high speed.

Particularly in the upper transporting path 241*a*, since a large amount of the developer 8 transported at high speed in the direction of the arrow K2 by the transporting unit 245 in the lower transporting path 241*b* is fed into the upper transporting path 241*a* through the connection passage 241*d* on the front side, as shown by a two-dot chain line in FIG. 9, the developer 8 is transported such that a relatively large amount of developer 8 temporarily exists at the front end portion of the transporting path 241*a*. In addition, in the upper transporting path 241*a*, most of the developer 8 fed from the lower transporting path 241*b* is transported at high speed in the direction of the arrow J2 by the transporting unit 244. However, as shown in FIGS. 9 and 10A, the most of the transported developer 8 is more accumulated in the portion from the connection passage 241*d* on the front side to the front of the discharge port 247 and the periphery thereof, and the surface (bulk) of the developer 8 rises.

Figure 10A:
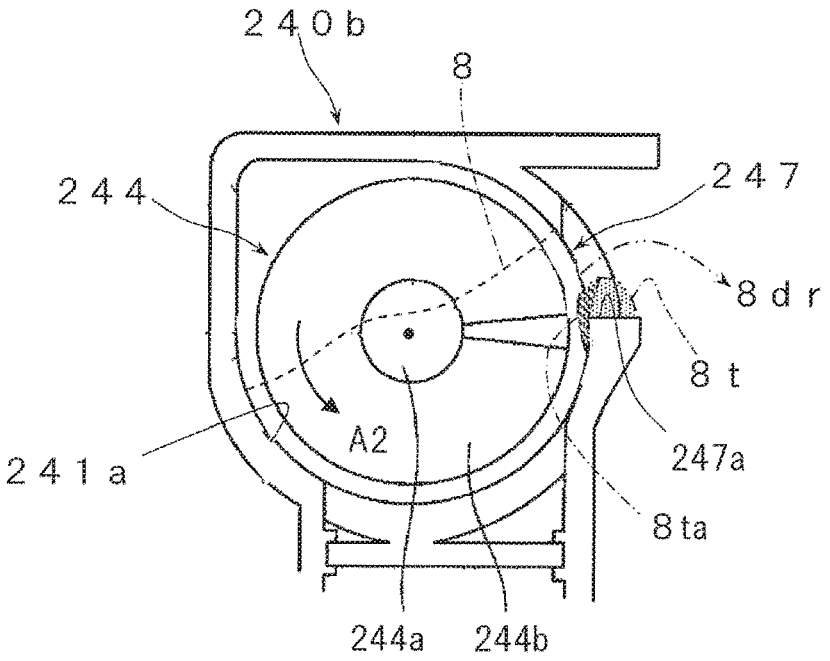
FIG. 10A is a schematic end view showing a state of the transporting unit and the developer in a vicinity of the discharge port when the first operation is executed.

As a result, when the first operation is executed, in the upper transporting path 241*a*, since the developer 8 is transported in a state where the developer 8 is scooped up to the discharge port 247 by the transporting unit 244 which reversely rotates at high speed in the direction of the arrow A2 as shown in FIG. 10A, a portion of the developer 8*dr* passes over the discharge port 247 and is easily discharged. The developer 8*dr* discharged at this time is discharged as long as the discharge port 247 has a gap, even if the developer 8*t* attached to be accumulated in a part 247*a* of the discharge port 247.

Therefore, in the image forming apparatus 1, when the consumption amount of the toner falls below the threshold value and the flowability of the developer 8 becomes worse, the first operation is executed in the developing device 24, whereby the discharge of the developer 8*dr* from the discharge port 247 is favorably performed, so that the defective discharge of the developer from the discharge port 247 is eliminated.

In addition, according to the research of the present inventors, when the first operation is performed in a state where the developer 8*t* attached to the part 247*a* of the discharge port 247 is present, as shown in FIG. 10A, it is checked that the portion 8*ta* of the attached developer 8*t* present inside the transporting path 241*a* is transported by the transporting unit 244 rotating in reverse at high speed and scraped off by the developer 8 moving more vigorously than at the time of development.

Also by the effect of scraping off with the developer 8, in the image forming apparatus 1, the clogging state of the discharge port 247 caused by the presence of the attached developer 8*t* in the developing device 24 is alleviated, and the developer 8*dr* is more favorably discharged from the discharge port 247, so that the defective discharge of the developer from the discharge port 247 is further eliminated.

While the first operation is executed, the control unit 15 checks whether the execution time exceeds the threshold value Ta (for example, 5 seconds in this example) (S13), and the first operation is stopped when it is determined that the execution time exceeds the threshold value Ta (S14).

Since the operation corresponding to the first operation of the developing drive device 29 is stopped by the control of the control unit 15, the transporting units 244 and 245 which have been reversely rotated at high speed in the developing device 24 are stopped.

Next, when the first operation is stopped, the control unit 15 executes the second operation in the developing device 24 (S15).

That is, in this case, under the control of the control unit 15, the developing drive device 29 operates with the content corresponding to the second operation, whereby the transporting units 244 and 245 in the developing device 24 are forwardly rotated at the high speed V3. At this time, as shown in FIG. 4 and the like, the forwardly rotating transporting unit 244 rotates in the same direction of arrow A1 as at the time of development, and the forwardly rotating transporting unit 245 also rotates in the same direction of arrow B1 as at the time of development.

At this time, in the upper transporting path 241*a*, as shown in FIG. 6, the developer 8 is transported in the direction of the arrow J1 in the same manner at the time of development by the transporting unit 244 forwardly rotating at high speed, and the developer 8 is transported at a speed higher than the transporting speed at the time of development because the transporting unit 244 is rotating at high speed. At this time, the developing roller 243 is forwardly rotated at high speed by the transmission of the rotational power at the time of operation with the content corresponding to the first operation of the developing drive device 29.

In addition, in the lower transporting path 241*b*, as shown in FIG. 6, the developer 8 is transported in the direction of the arrow K1 in the same manner at the time of development by the transporting unit 245 forwardly rotating at high speed, and the developer 8 is transported at a speed higher than the transporting speed at the time of development because the transporting unit 245 is rotating at high speed.

In the upper transporting path 241*a*, as shown by a two-dot chain line in FIG. 9 and a dashed line in FIG. 10A, the developer 8 (surface of the developer 8 at a portion surrounding the discharge port 247 in the transporting path 241*a*, which is indicated by a two-dot chain line in FIG. 9) accumulated in a large amount in the portion in front of the discharge port 247 and the periphery thereof starts to be transported in the direction indicated by the arrow J1 by the first operation being performed. In addition, since the transporting unit 244 at this time is rotating at high speed, the developer 8 accumulated a lot in a portion in front of the discharge port 247 is also moved in response to the energetic transporting force of the transporting blade 244*b* of the transporting unit 244, so that the internal pressure in the transporting path 241*a*, which is the end portion on the front side, is temporarily raised. In addition, the portion of the transporting path 241*a* which is the end portion on the front side is also a portion where the gap space with the transporting blade 244*b* of the transporting unit 244 is relatively narrow as described above, so that the internal pressure is likely to rise as well.

Figure 10B:
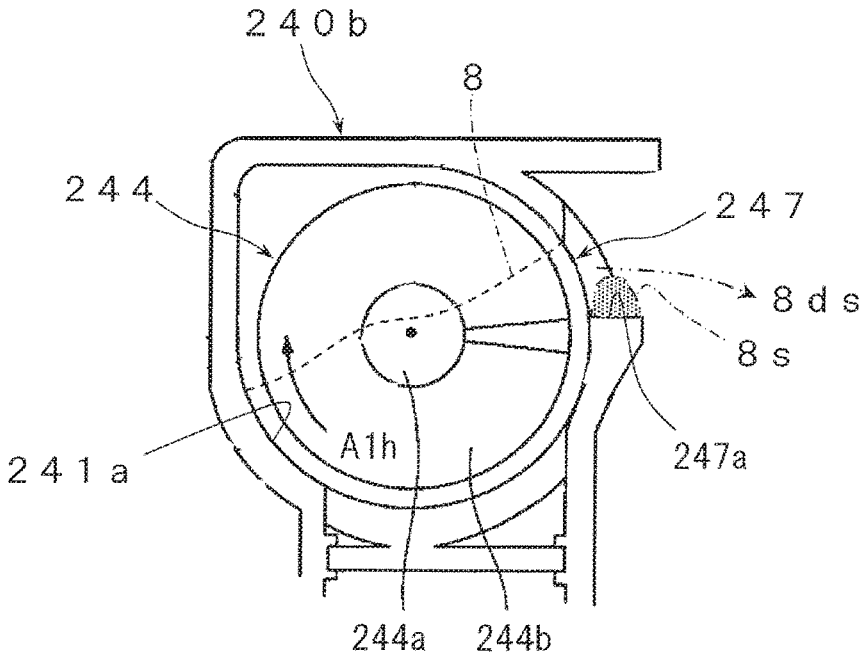
FIG. 10B is a schematic end view showing a state of the transporting unit and the developer in the vicinity of the discharge port when the second operation is executed.

As a result, when the second operation is executed, in the upper transporting path 241*a*, since the developer 8 is transported in a state that the developer 8 vigorously passes through the discharge port 247 by the transporting unit 244 which forwardly rotates at high speed in the direction of arrow A1 as shown in FIG. 10B, a portion of the developer 8*ds* passes over the discharge port 247 and is easily discharged.

In addition, the surface of the developer 8 that is unevenly distributed in the upper transporting path 241*a* by the execution of the first operation is also gradually leveled by the transporting unit 244 rotating forwardly at high speed, and returned to the state of the remaining surface at the time of development (FIG. 6).

At this time, since the developer 8*ds* discharged from the discharge port 247 moves in the transporting path 241*a* where the internal pressure is risen with momentum, even if there is the developer 8*ds* attached to the portion 247*a* of the discharge port 247 remaining after a portion is scraped off in the first operation, the developer 8*ds* is discharged in a crushed manner. As a result, in the discharge port 247, the developer 8*t* and the like attached to a portion of the discharge port 247 is almost completely eliminated (FIG. 5B), and the discharge of the developer from the discharge port 247 is in a normal state.

Therefore, in the image forming apparatus 1, the developer 8*ds* is further favorably discharged from the discharge port 247 by performing the second operation following the first operation in the developing device 24, the defective discharge of the developer from the discharge port 247 is more reliably eliminated. In addition, in the image forming apparatus 1, the first operation and the like are executed when the consumption amount of the toner falls below the threshold value, so that the occurrence of the defective discharge of the developer at the discharge port 247 is prevented.

While the second operation is executed, the control unit 15 checks whether the execution time exceeds the threshold value Tb (for example, 30 seconds in this example) (S116), and the second operation is stopped when it is determined that the execution time of the second operation exceeds the threshold value Tb (S17).

Since the operation for the second operation of the developing drive device 29 is stopped by the control of the control unit 15, the transporting units 244 and 245 forwardly rotated at high speed are stopped in the developing device 24.

Hereinafter, results obtained by measuring when various operations are executed on the developing device 24 will be described.

Figure 11A:
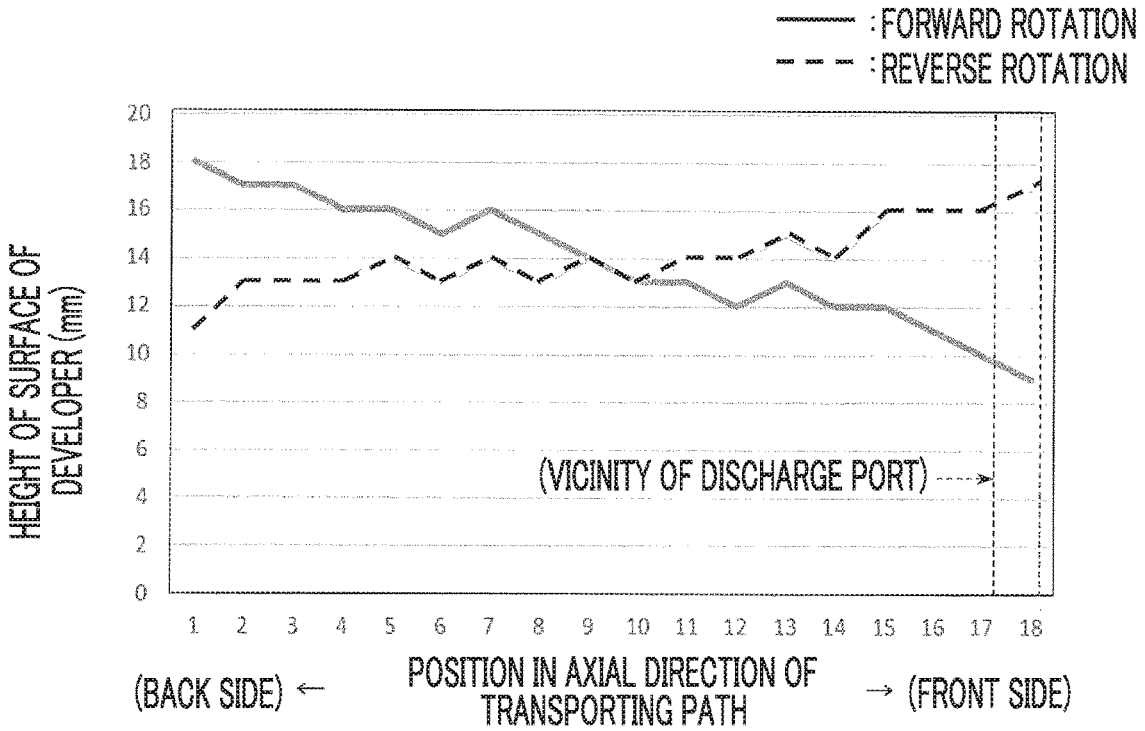
FIG. 11A is a graph showing a measurement result 1 when an operation related to the developing device is performed.

First, in the case where the transporting unit 244 and the like in the developing device 24 are forwardly and reversely rotated, FIG. 11A shows the measurement result 1 of the surface level of the developer 8 in the upper transporting path 241*a*.

The height of the surface of the developer 8 is measured using a stainless steel ruler. In addition, the rotational speed during the forward rotation of the transporting unit 244 and the rotational speed during the reverse rotation are the same (in practice, the number of revolutions when it corresponds approximately to the rotational speed V1 at the time of development: 2267 rpm). In addition, the measurement at this time is performed by measuring the height of the developer surface after rotating the transporting unit 244 for 120 seconds from the initial state of storing the same amount of developer 8 in the transporting path 241*a* and leveling the surface almost evenly.

Incidentally, the height from the bottom portion of the transporting path 241*a* at the lower side of the discharge port 247 at this time is 14.5 mm. The transporting unit 244 uses the transporting blade 244*b* whose diameter (D) is 24 mm.

From the result 1 shown in FIG. 11A, it is understood that, in the developing device 24, the height of the surface of the developer 8 at the portion (position) in front of the discharge port 247 is raised by rotating the transporting unit 244 and the like in reverse.

Figure 11B:
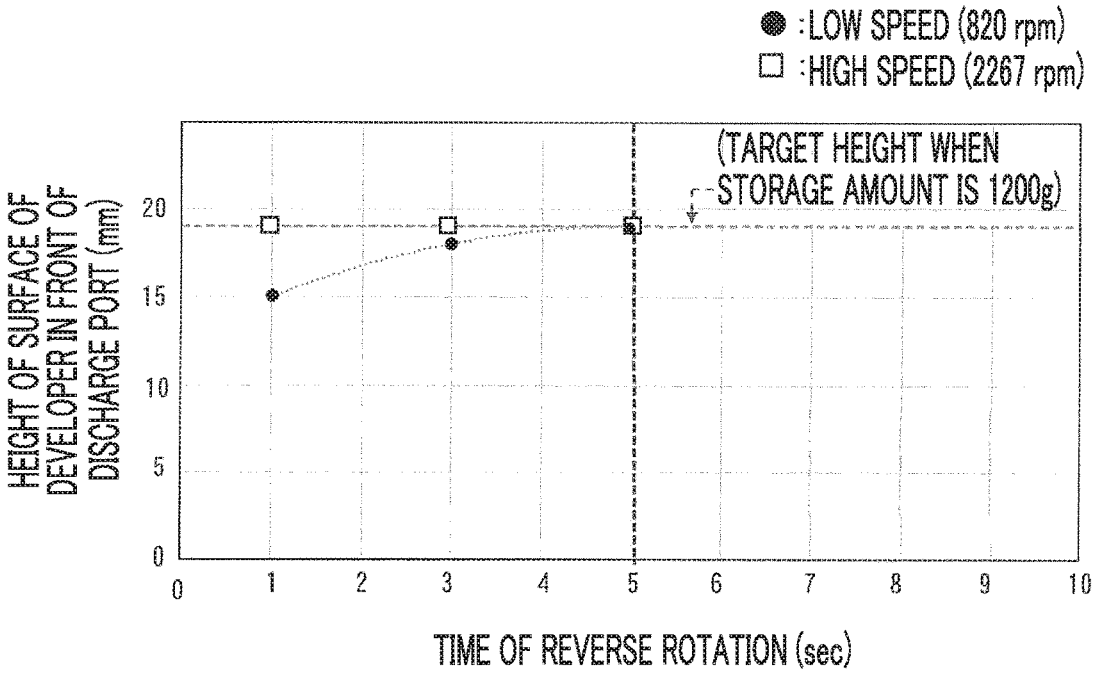
FIG. 11B is a graph showing a measurement result 2 when another operation is performed.

In addition, when the transporting unit 244 in the developing device 24 is reversely rotated at low speed and high speed, respectively, FIG. 11B shows the result 2 of measuring the transition of the surface level of the developer 8 in the portion in front of the discharge port 247 in the upper transporting path 241*a*.

In this measurement, the results when the transporting unit 244 is reversely rotated at each speed are measured from a state in which a total of 1,200 g of the developer 8 is stored in the storage chamber 241 of the developing device 24 and the height of the surface of the developer in the initial state at the portion in front of the discharge port 247 is 11 mm. In addition, the target developer surface height is set to the height (19 mm) of the developer surface, which is a standard for the developer 8 to be favorably discharged from the discharge port 247 when reverse rotation is performed.

From the result 2 shown in FIG. 11B, it can be understood that the developing device 24 achieves the target height in about one second when reverse rotation is performed at high speed (2267 rpm), while the developing device 24 achieves the target height in about five seconds when the transporting unit 244 is reversely rotated at a low speed (829 rpm) that is lower than the rotational speed V1 when forwardly rotating at the time of development. The high speed at this time is the speed applied when this measurement is performed, and corresponds to the rotational speed (number of revolutions) when forwardly rotating at the time of development.

Figure 12:
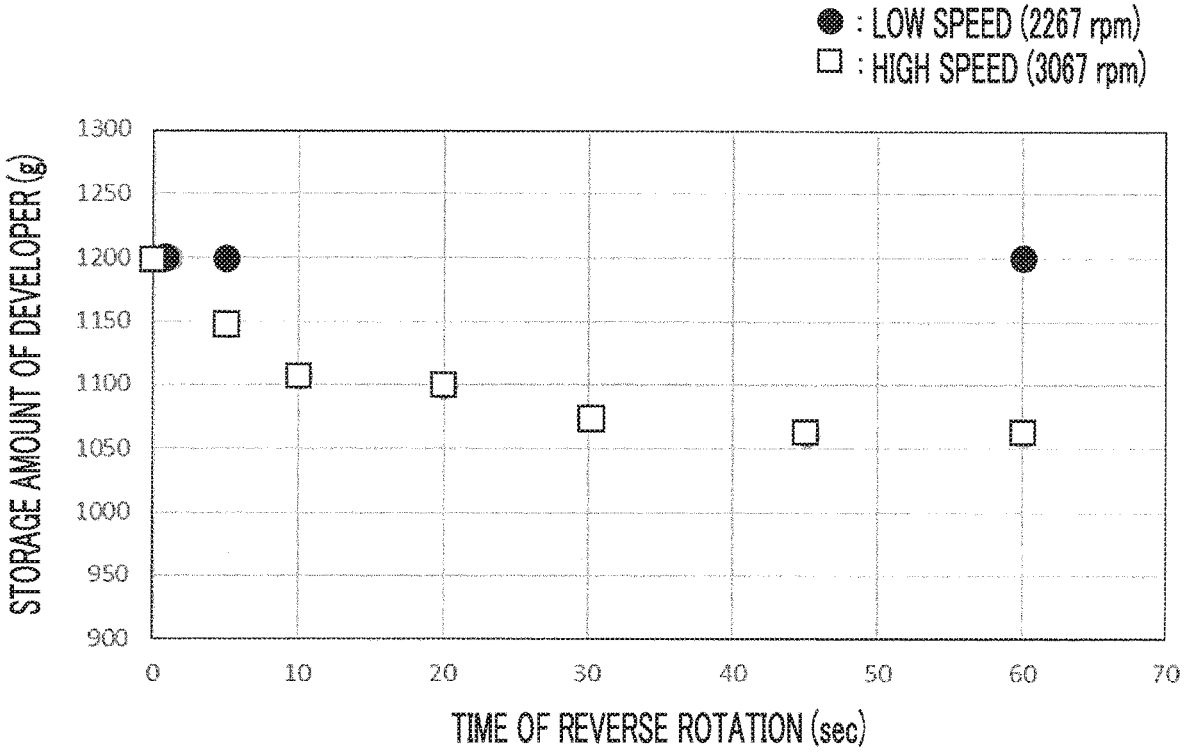
FIG. 12 is a graph showing a measurement result 3 when an operation related to the developing device is performed.

Furthermore, when the transporting unit 244 and the like are reversely rotated at low speed and high speed in the developing device 24, FIG. 12 shows the measurement result 3 of the storage amount of the developer 8 stored in the storage chamber 241 of the housing 240.

The measurement at this time is performed by measuring the storage amount of the developer 8 at each time when a predetermined time (early 5 seconds and every 10 seconds thereafter) elapses by reverse rotation at each speed (number of revolutions) in a state where a total of 1,200 g of the developer 8 is stored in the storage chamber 241 of the developing device 24. That is, the storage amount of the developer 8 at each elapsed time is the difference between the initial storage amount at each elapsed time point and the previous discharge amount of the discharge port 247. At this time, the developing roller 243 is not rotated, and the adsorption of the developer 8 to the developing roller 243 is not performed.

From the result 3 shown in FIG. 12, in the case of reverse rotation at low speed (rotational speed at the time of development), the storage amount of the developer 8 is almost the same as the initial value even after 60 seconds from the start, and thereby, it is assumed that almost no developer is discharged from the discharge port 247. On the other hand, in the case of reverse rotation at high speed, the storage amount of the developer 8 starts to decrease 5 seconds after the start, and the storage amount of the developer 8 continues to decrease until 60 seconds is elapsed. Accordingly, it can be understood that the discharge of the developer from the discharge port 247 is properly performed.

From this, it is found that, when the developing device 24 executes an operation to reversely rotate the transporting unit 244 and the like at a high speed, the developer is properly discharged from the discharge port 247.

Figure 13:
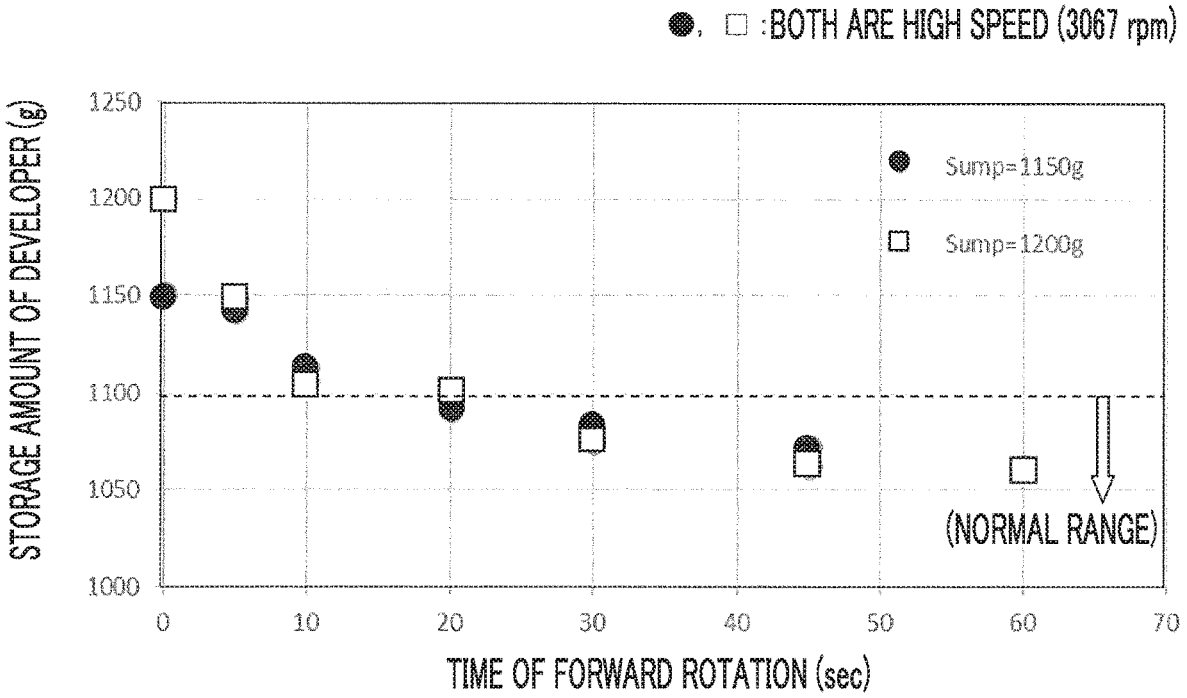
FIG. 13 is a graph showing a measurement result 4 when an operation related to the developing device is performed.

Next, when the transporting unit 244 and the like are forwardly rotated at high speed in the developing device 24, FIG. 13 shows the measurement result 4 of the storage amount of the developer 8 stored in the storage chamber 241 of the housing 240.

The measurement at this time is performed by measuring the storage amount of the developer 8 at each time in the same manner in the case of the test result shown in FIG. 12 when a predetermined time (early 5 seconds and every 10 seconds thereafter) elapses by forwardly rotating the transporting unit 244 at high speed (3067 rpm) in a state where 1,150 g of the developer 8 and 1,200 g of the developer 8 are respectively stored in the storage chamber 241 of the developing device 24 as the initial storage amount. At this time, the developing roller 243 also rotates forwardly at high speed.

From the result 4 shown in FIG. 13, when the transporting unit 244 and the like are forwardly rotated at high speed, the storage amount of the developer 8 continues to decrease regardless of the difference in the initial storage amount of the developer 8. Accordingly, it is understood that the discharge of the developer from the discharge port 247 is properly performed. Also in this case, regardless of the difference in the initial storage amount of the developer 8, it can be seen that the storage amount of the developer 8 almost reaches a predetermined normal range (1100 g or less) after 20 seconds from the start.

Since the speed at which the storage amount of the developer 8 decreases is relatively higher when the initial storage amount is large compared to the case where the initial storage amount is small, it can be seen that the discharge of the developer from the discharge port 247 is performed even better.

From this, it is found that, in the developing device 24, when the operation of forwardly rotating the transporting unit 244 and the like is performed at high speed, the developer is properly discharged from the discharge port 247. In addition, in the developing device 24, it is also found that in the case where a large amount of developer 8 is stored in the transporting path 241*a* and the like, the discharge of the developer from the discharge port 247 is performed better than in the case where the storage amount thereof is small.

Figure 14A:
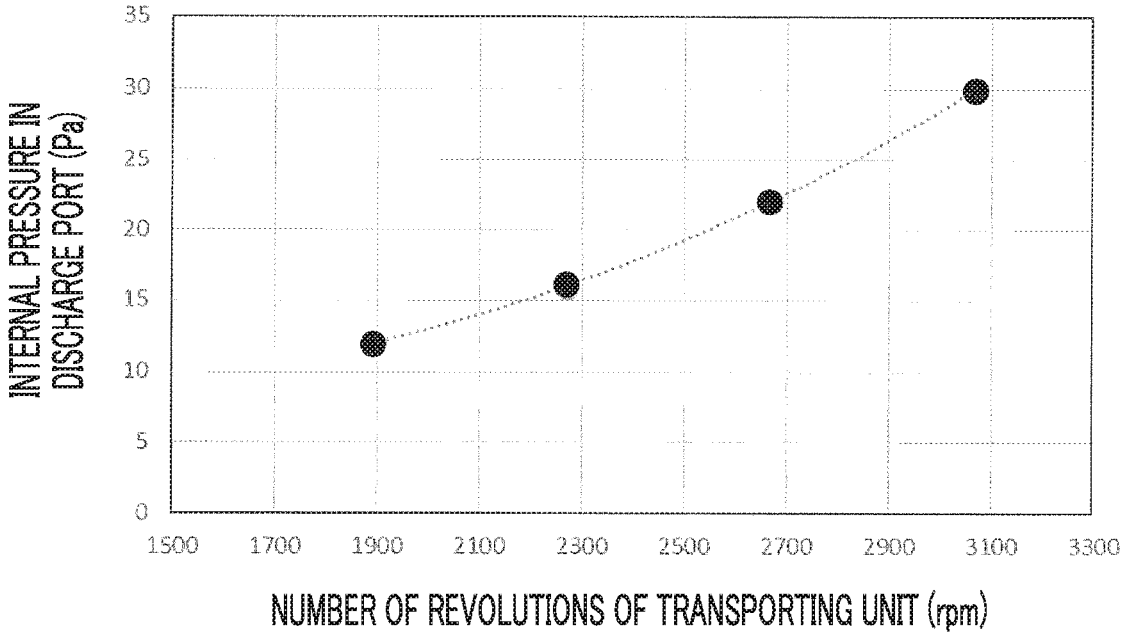
FIG. 14A is a graph showing a measurement result 5 when an operation related to the developing device is performed.

In addition, when the transporting unit 244 and the like are forwardly rotated at high speed in the developing device 24, FIG. 14A shows a measurement result 5 of the internal pressure in the discharge port 247 generated by the movement of the developer 8 or the rotation of the transporting unit 244 in the upper transporting path 241*a* when the rotational speed (number of revolutions) of the electric motor, which is a drive source for rotating the transporting unit 244 and the like, is increased.

In this measurement, the internal pressure at the discharge port 247 is measured using a pressure measuring device (manufactured by OMRON: pressure sensor E8Y with display). In addition, the position at which the internal pressure is measured is the position of the discharge port 247 in the transporting path 241*a*.

From the result 5 shown in FIG. 14A, when the rotational speed (number of revolutions) of the electric motor is increased and the transporting unit 244 and the like are forwardly rotated at a higher speed, it can be seen that the internal pressure of the developer 8 in the upper transporting path 241*a* rises.

From this, when the developing device 24 executes an operation of forwardly rotating the transporting unit 244 and the like at a higher speed, the internal pressure of the developer 8 in the vicinity of the discharge port 247 is increased, and a portion of the developer 8 can be discharged from the discharge port 247, and further it is assumed that the developer 8 whose internal pressure is risen can also crush the mass of the developer 8 attached to the discharge port 247.

Figure 14B:
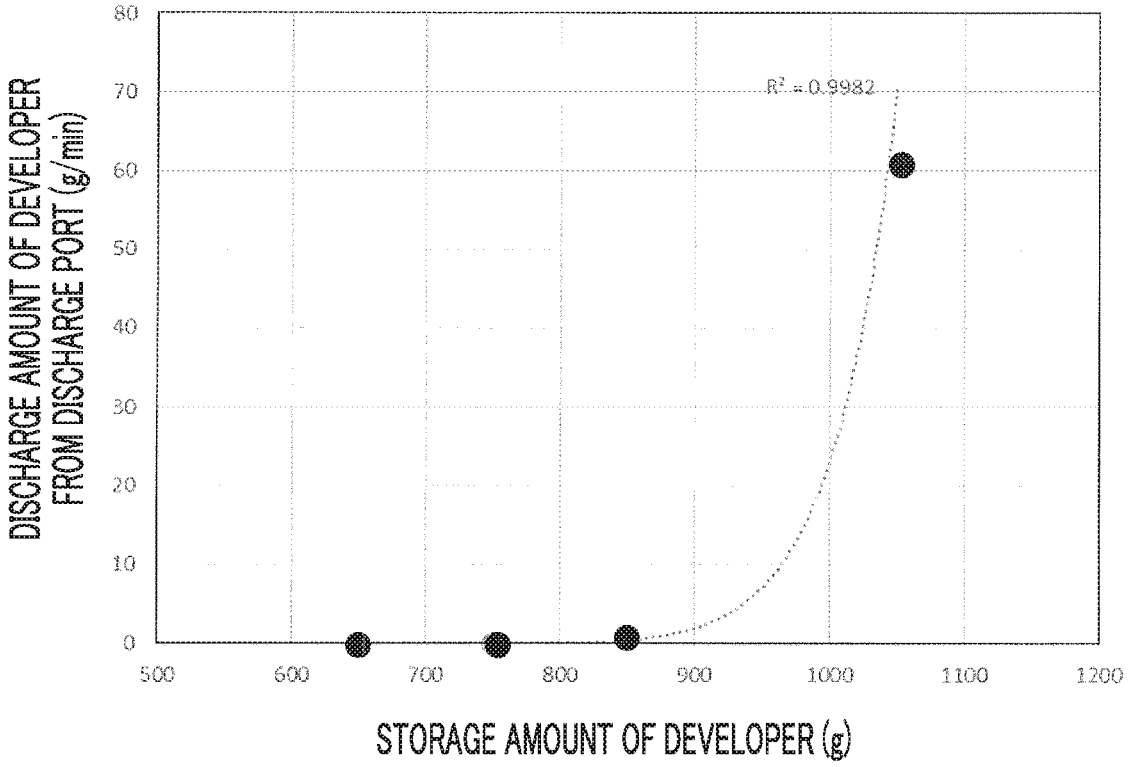
FIG. 14B is a graph showing a measurement result 6 when another operation related to the developing device is performed.

Finally, when the transporting unit 244 and the like are forwardly rotated in the developing device 24, FIG. 14B shows a measurement result 6 of the discharge amount of the developer 8 from the discharge port 247 when the storage amount of the developer 8 stored in the storage chamber 241 is changed.

In this measurement, the transporting unit 244 and the like are forwardly rotated at a high speed of 3067 rpm. The discharge amount of the developer 8 is measured from the amount actually discharged from the discharge port 247.

From the result 6 shown in FIG. 14B, it can be seen that when the storage amount of the developer 8 is made smaller than 900 g, the developer 8 is hardly discharged from the discharge port 247, and even when the storage amount of the developer 8 is 1,150 g, the developer 8 is not excessively discharged from the discharge port 247. The excessive discharge of the developer 8 from the discharge port 247 means a case where the discharge amount is 0.1 g/min or more.

Modification Example

The present disclosure is not limited to the content exemplified in Exemplary Embodiment 1, and can be variously modified without departing from the scope of each disclosure described in each aspect. For this reason, the present disclosure also includes modification examples as exemplified below.

In Exemplary Embodiment 1, the configuration example in which the second operation is executed after the execution of the first operation is described, but only the first operation may be executed without the execution of the second operation.

Even when only the first operation is executed, the developer is properly discharged from the discharge port 247, and the defective discharge at the discharge port 247 is eliminated. The point that such an effect is obtained and is effective is also apparent, for example, in light of the measurement results shown in FIG. 12.

In addition, in Exemplary Embodiment 1, as a detection unit 16 for detecting the consumption amount of the toner in the developer 8, for example, it may be configured using a toner concentration sensor capable of detecting the concentration of the toner of the developer 8 stored in the transporting path 241*a* of the developing device 24. In this case, for example, it is possible to set the case where the toner concentration detected by the toner concentration sensor has a relatively small amount of change with respect to the number of pages of image formation as the threshold value.

Further, in Exemplary Embodiment 1, the developing device 24 of the vertical transport type is shown in which the plural transporting units 244 and 245 are divided and arranged in the vertical direction along the gravitational direction and transport the developer 8 to circulate the developer 8 in the vertical direction. However, the developing device to which the present disclosure can be applied may be a developing device of transport type (for example, horizontal transport type) other than the vertical transport type. Developing devices of transport types other than vertical transport type are the following developing devices. That is, plural transporting units are divided and arranged in a direction intersecting the gravitational direction (as a representative example, the direction is a horizontal direction substantially orthogonal to the gravitational direction, but includes directions obliquely intersecting the gravitational direction) and transports the developer 8 to circulate the developer 8 in the intersecting direction.

In addition, the image forming apparatus to which the present disclosure is applied is provided with a developing device for performing development with a two-component developer and adopting a trickle method, and may be an image forming apparatus capable of executing the first operation or the first operation and the second operation of the transporting unit in the developing device, and the format, type, image forming method, and the like are not particularly limited. Therefore, the image forming apparatus provided with plural developing devices may be used without any problem.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a developing device configured to transport a two-component developer by a transporting unit so that the two-component developer passes through a developing roller, the two-component developer including a toner and a carrier, the two-component developer being stored in a storage chamber provided with a transporting path, the transporting unit rotating in the transporting path, and cause a portion of the two-component developer which is being transported by the transporting unit to overflow from a discharge port provided at the transporting path, and to discharge the two-component developer out of the storage chamber, wherein the image forming apparatus has a period in which a first operation is executed, the first operation of reversely rotating the transporting unit at a high speed so that (i) a rotational direction of the transporting unit is an opposite direction to that at a time of development and (ii) a rotational speed of the transporting unit is higher than that at the time of development.

2. The image forming apparatus according to claim 1, wherein the image forming apparatus has a period in which a second operation is executed, after the first operation is executed, and in the second operation, the transporting unit is forwardly rotated at a high speed so that (i) the rotational direction of the transport unit is the same direction as the rotational direction at the time of development and (ii) the rotational speed of the transport unit is higher than that at the time of development.

3. The image forming apparatus according to claim 2, wherein an execution time of the second operation is longer than that of the first operation.

4. The image forming apparatus according to claim 3, wherein the first operation is executed when a consumption amount of the toner in the two-component developer falls below a threshold value.

5. The image forming apparatus according to claim 3, wherein the developing device is a vertical transport type developing device comprising plural transporting units as the transporting unit, the plural transporting units are divided and arranged in a vertical direction along a gravitational direction, and the plural transporting units transport the two-component developer to circulate the two-component developer in the vertical direction.

6. The image forming apparatus according to claim 4, wherein the developing device is a vertical transport type developing device comprising plural transporting units as the transporting unit, the plural transporting units are divided and arranged in a vertical direction along a gravitational direction, and the plural transporting units transport the two-component developer to circulate the two-component developer in the vertical direction.

7. The image forming apparatus according to claim 2, wherein the first operation is executed when a consumption amount of the toner in the two-component developer falls below a threshold value.

8. The image forming apparatus according to claim 7, wherein the developing device is a vertical transport type developing device comprising plural transporting units as the transporting unit, the plural transporting units are divided and arranged in a vertical direction along a gravitational direction, and the plural transporting units transport the two-component developer to circulate the two-component developer in the vertical direction.

9. The image forming apparatus according to claim 2, wherein the developing device is a vertical transport type developing device comprising plural transporting units as the transporting unit, the plural transporting units are divided and arranged in a vertical direction along a gravitational direction, and the plural transporting units transport the two-component developer to circulate the two-component developer in the vertical direction.

10. The image forming apparatus according to claim 1, wherein the first operation is executed when a consumption amount of the toner in the two-component developer falls below a threshold value.

11. The image forming apparatus according to claim 10, wherein the developing device is a vertical transport type developing device comprising plural transporting units as the transporting unit, the plural transporting units are divided and arranged in a vertical direction along a gravitational direction, and the plural transporting units transport the two-component developer to circulate the two-component developer in the vertical direction.

12. The image forming apparatus according to claim 1, wherein the developing device is a vertical transport type developing device comprising plural transporting units as the transporting unit, the plural transporting units are divided and arranged in a vertical direction along a gravitational direction, and the plural transporting units transport the two-component developer to circulate the two-component developer in the vertical direction.

13. An image forming apparatus comprising:

developing means for transporting a two-component developer by transporting means so that the two-component developer passes through a developing roller, the two-component developer including a toner and a carrier, the two-component developer being stored in storage means provided with a transporting path, the transporting means rotating in the transporting path, and causing a portion of the two-component developer which is being transported by the transporting means to overflow from a discharge port provided at the transporting path, and to discharge the two-component developer out of the storage chamber, wherein the image forming apparatus has a period in which a first operation is executed, the first operation of reversely rotating the transporting means at a high speed so that (i) a rotational direction of the transporting means is an opposite direction to that at a time of development and (ii) a rotational speed of the transporting means is higher than that at the time of development.

* * * * *